United States Patent [19]

Smith

[11] Patent Number: 4,943,050

[45] Date of Patent: Jul. 24, 1990

[54] ONE LEG EXERCISER

[76] Inventor: Robert S. Smith, 1263 Emory St., San Jose, Calif. 95126

[21] Appl. No.: 337,347

[22] Filed: Apr. 13, 1989

[51] Int. Cl.[5] ..... A63B 23/04

[52] U.S. Cl. ..... 272/70; 272/69; 272/96; 128/25 B

[58] Field of Search ..... 272/69, 70, 96, 131; 128/25 B, 25 R

[56] References Cited

U.S. PATENT DOCUMENTS

| | | | |
|---|---|---|---|
| 3,580,083 | 5/1971 | Zipser | 272/69 X |
| 3,602,502 | 8/1971 | Hampl | 272/69 |
| 4,216,956 | 8/1980 | Yamamura et al. | 272/70 |
| 4,521,010 | 6/1985 | Hahn | 272/131 X |
| 4,749,182 | 6/1988 | Duggan | 272/131 X |

FOREIGN PATENT DOCUMENTS

| | | | |
|---|---|---|---|
| 54-140628 | 11/1979 | Japan | 272/70 |
| 1326295 | 7/1987 | U.S.S.R. | 272/69 |

OTHER PUBLICATIONS

"Graphic Symbols for Electronic Circuits", by Electronics Magazine, 1982.

*Primary Examiner*—Richard J. Apley
*Assistant Examiner*—Joe H. Cheng
*Attorney, Agent, or Firm*—Robert S. Smith

[57] ABSTRACT

An exerciser to develop muscles used in running in which a user stands on one foot and strokes a wheel with the other foot causing the wheel to rotate. The resistance to turning of the wheel which corresponds to horizontal force can be preset by the user. The rotational velocity attained by the wheel corresponds to leg speed when the foot hits the ground. The wheel is mounted on a hinge support so that the device also monitors stroke frequency and the vertical force with which the foot hits the wheel.

12 Claims, 2 Drawing Sheets

ONE LEG EXERCISER

BACKGROUND OF THE INVENTION

1. Field

This invention relates to the treadmill type of exerciser and particularly to an exerciser operated by one leg which sets a standard for the basic components of running—footspeed, vertical thrust, horizontal thrust and frequency.

2. Prior Art

The basic capabilities that determine a runners maximum speed include his footspeed at the instant his foot contacts the ground, the horizontal thrust of his foot against the ground, the vertical thrust of his foot against the ground, and the frequency with which his foot contacts the ground. All of these capabilities vary from one individual to another. To some extent, deficiency in one capability can be compensated for by proficiency in another capability. This explains why individuals with different proficiencies in a given capability can be equally good (or poor) runners. For example, one runner with a short stride and large frequency may be as fast as another runner using a long stride and smaller frequency.

It is important to understand that we are addressing independent capability, not the actual performance of a given component during running. For example, the muscle group in a runners legs that determine frequency may be more proficient than the muscle group that determines foot speed (indicating that the runners hip extensors are more developed than his hip flexors). Then the runner will not be able to reach his maximum value of frequency because he will be limited by his foot speed. All of the components are related and the net result (top running speed) tends to be determined by the weakest component.

To consider each of these components individually—

A runner can have great foot speed (frequency) when the foot is out of contact with the ground, but, if he has a limited range of motion in his "back kick" then he can have slow foot speed when the foot is making ground contact because his muscles may be preparing for the forward swing. For example, a runner can be "running in place" (be stationery) at which point his foot speed at ground contact is zero and still be pumping his knees up and down at great frequency. In order to benefit from fast footspeed, a runner must either be able to have sufficient flexibility so as to execute an exaggerated hip flexion or he must have sufficient lean so that his hip is not in the process of converting from extension to flexion at the instant of foot contact. The former runner who is fast tends to have a more willowy (flexible) build whereas the latter runner who is equally fast tends to be more powerfully built.

A runner may have great foot speed but a relatively low reaction time (stride frequency.) If he has good vertical thrust (the vertical force) with which his foot hits the ground, then he can compensate for lower stride frequency.

Horizontal thrust has a very important influence on acceleration. During a short race of, say, 60 yards, the runner is accelerating from start to finish. Beyond 60 yards, most all runners have reached their top speed and are deccelarating. Therefore, development of horizontal thrust is important to a sprinter both in order to enable him to accelerate as great as possible in the first stage of the race, and to have the endurance to maintain his top speed as long as possible in the last part of the race.

The foregoing four factors are all related to one instant of the sprinters stride—the instant of foot contact. There are two other components whose importance cannot be discussed in terms of how they are directly related to the sprinters speed, but they can be discussed in terms of how they influence the four components that are directly related to speed. These two components are knee lift and back kick. It is useful to consider these two components separately.

Increasing the knee lift obviously does not increase frequency. In fact, increasing knee lift decreases frequency. However, by extending the range of motion within which the hip extensors are operative, the leg gains greater momentum by increasing knee lift so that vertical thrust, horizontal thrust and foot speed can be greater.

Most good sprinters have a high back kick. It is not the fact of the back kick per se that contributes to the speed. The back kick is simply an indication that the sprinters leg is in that range of motion where the angular velocity of his leg is great rather than at the end of its swing so that he has fast foot speed at ground contact.

The building of muscle groups involved in sprinting has historically been addressed by a sprinter going out on the track and running. There are certain exercises that he does which are intended to improve the various components discussed in the foregoing paragraphs, some of which are performed on the track and others of which are performed in the exercise room. The former exercises include hopping, running up bleacher steps, "eggshell" running in place, running with exaggerated knee lift, running with exaggerated back kick. In the exercise room, the sprinter may perform situps, squats, lunges, etc. in an effort to build strength. Efforts to build frequency have been made by hanging onto cars, holding one end of a stretched rubber band. These techniques are helpful but they are not nearly as effective as the techniques associated with the present invention. One reason is that the exercises (including the act of sprinting) do not "isolate".

A number of these exercises are extended to improve the "reaction time" of the user. Reaction time (or maximum frequency capability of the users muscle group) is determine by the quantity and quality of the Fast Twitch component of muscle fiber. U.S. Pat. No. 4,728,100 discloses a device and method of use involving interruption of a light beam as a means of signalling reaction time to a user as his exercise is in practice.

By isolate is meant that a particular muscle group is the major one providing the force for the exercise. When an exercise is performed that isolates on a particular muscle group, the entire cardiovascular system of the body supports that muscle group so that stress is concentrated on the muscle group. In the act of sprinting, the cardiovascular system must support the whole body so the physiological factor that limits stress on any of the involved muscle groups is the condition of the cardiovascular system.

U.S. Pat. No. 4,456,248 discloses an apparatus and program that can be used to isolate on muscle groups important for sprinting. The exercises disclosed are especially useful for building strength that can reduce the chance of injury associated with sprinting. However, the use of this apparatus can not be totally relied upon because it does not develop coordination associated with the act of running nor does it develop neurological proficiency. Use of this apparatus in combination with exercises performed on the apparatus of the present invention would provide the optimum exercise program.

Treadmills have been used for many years. These devices are looped belts that are run at controlled speeds so that a person standing on the belt is forced to walk "in place" at a speed dependent on the speed of the belt. Means are provided to tilt the belt to simulate the situation where the user is "walking uphill". These apparatus are often equipped with devices to measure heart and respiration rate, etc. They are really intended for people requiring moderate carefully controlled exercise such as recovering heart patients, etc.

In the following paragraphs will be discussed a principle of exercise that is very important in training for the optiomum rate of development of strength and speed although it is a principle that is not widely known or at least appreciated in coaching and exercise circles.

The principle is best illustrated by a weight lifting program because weight lifting, contrary to sprinting, can be designed to incorporate very small well defined increases of exertion into the daily program.

In training for improvement of strength and speed, if an exercise is performed every day that is too close to maximum exertion, then the volume (number of sets) of exercise is limited, the athlete does not have sufficient recovery between exercise bouts, he is subject to stress related injury, and he eventually reaches a peak. He also suffers psychologically as he sees his recent gains evaporate. On the other hand, if his exertion is too far below his maximum capability, he will have a limited rate of strength increase. These maximum and minimum values of most desired exertions are rather close to one another and must be defined by the athlete himself. In weightlifting, the athlete can stay within his bounds simply because he can control to a fine degree the amount of weight on the bar. Sprinting is a different story, however, because an athlete has no way of knowing when he is exerting himself within the optimum range.

In weightlifting, he can bench press 300 lbs. in one workout, 302 in the next, 304 in the next, etc. In sprinting, he can not run a 100 yds in 10.5 in one session, 10.4 in the next 10.3 in the next. Yet gradual increase in intensity, starting from a comfortable level, is the most effective way to development.

THE INVENTION

Objects

It is an object of this invention to provide an apparatus and method for developing a users major components of sprinting—frequency, foot speed at ground contact, horizontal thrust, vertical thrust, knee lift and back kick.

It is another object that each of these components can be controlled, monitored and measured independent of each other.

It is another object that exercises with this apparatus be performed with one leg at a time in order to isolate on the one leg.

Summary

The apparatus of this invention comprises a box with a platform and a wheel with its axel horizontally positioned beneath the platform so that a portion of the rim protrudes above an opening in the platform.

The user stands on the platform on one leg and swings his other leg so that his foot contacts the rim and turns the wheel. The runners leg executes a motion that is similar to that of a leg performing the act of running.

In one embodiment, the wheel axel is rotationally supported on each end between two erect sides of a channel. The horizontal panel connecting the two sides parallel is adjacent to the bottom of the box. One end of the panel is hingeably attached to the floor so that the wheel is deflected "slightly" up and down by turning of the hinge each time the foot hits the spinning wheel. A spring assembly under the panel also supports the channel and the location of support is varied with respect to the hinge in order to vary the vertical thrust exerted by the leg required to cause a given deflection of the hinged channel. The axel is coupled to a generator that emits a voltage proportional to the rotational velocity of the wheel. An adjustable brake is applied to the wheel that inhibits rotation of the wheel. In another embodiment, a weighted wheel on the axel is added to provide a means to measure horizontal thrust at a given velocity.

In accordance with the objects of the invention, wheel velocity is a measure of foot speed; resistance applied against the wheel by the adjustable brake establishes horizontal thrust by the leg required to maintain the foot speed; frequency of deflection of the channel turning on its hinge is a measure of reaction time (stride frequency); setting of the channel support under the panel establishes a goal for vertical thrust by the user.

In one embodiment, the user sets a pair of thumb dial switches to set the desired frequency that he wishes to maintain. He sets the adjustable brake to impose the desired resistance of the wheel. He also positions the panel support to establish the vertical thrust that he wishes to exert. He adjusts a setting on a voltage comparator to establish the foot speed that he wants to maintain. The platform is positioned in front of a panel that has three signal lights which the user watches while he performs his exercise. A red light indicates sufficient leg speed. A yellow light indicates sufficient frequency. A green light indicates sufficient vertical thrust. (Of course, the switches could be arranged so that an inverse signal system of lights or a sound system could be used and this arrangement is also an embodiment of this invention.)

To perform the exercise, the user stands on the platform on one leg and uses a running type motion with the other leg to turn the wheel by repeated thrusts with his foot. If he turns the wheel fast enough as determined by his setting, the red light will come on. If his leg frequency equals the selected setting, the yellow light comes on; if his vertical thrust equals his setting, the green light will come on.

In accordance with the principles of biofeedback the athlete will adjust the stroke of his leg to work toward the objective of keeping all the lights on. As a coach accumulates data from various members of his team, he will learn the combinations of settings that will best suit his sprinter. The sprinter will also learn where his weak and strong components are.

The sprinter can also carry out a graduated program of component development that is most effective in developing the components individually while coordinating development of one component with all the other components. This is an extremely important point for any program intended to build optimum physiological proficiency—strength, speed in a given muscle group.

DESCRIPTION OF A PREFERRED EMBODIMENT

Figure 1:
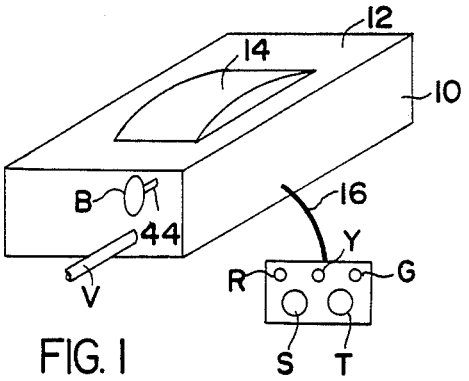
FIG. 1 shows an isometric view of the one leg exerciser.

Turning to a detailed discussion, FIG. 1 is an isometric view of the exerciser showing a box 10 with a platform 12 having a rectangular opening with the rim of a wheel 14 protruding through a rectangular opening in the top of the box. A cable 16 coming out of the box is connected to a panel of three lights, R, Y, G (red, yellow and green) and two knobs, S and F.

The setting of knob S determines how fast the wheel must rotate in order to turn on speed light R.

The setting of knob T determines how frequently the user must stroke the wheel (stride frequency) in order to turn on light Y.

A third knob B on a side of the box is set to determine the horizontal thrust that must be applied by the foot on the wheel to overcome the resistance to rotation.

The position of rod V that slides in and out of the box determines how much vertical force on the wheel is required to turn on light G. The user first sets the three knobs and rod to values that are his target in the exercise bout. Then he stands on one foot on the platform 12 beside the wheel (with his hands on a wall or table, etc to maintain balance) and faces the panel. He strokes the wheel with one foot in a running type of motion. He adjusts his stroke accordingly in an attempt to keep the lights on.

In the early stages of his development, he sets the knobs and rod at easy levels. With each successive exercise workout, he increases the levels according to his ability to "keep the lights on".

Figure 2:
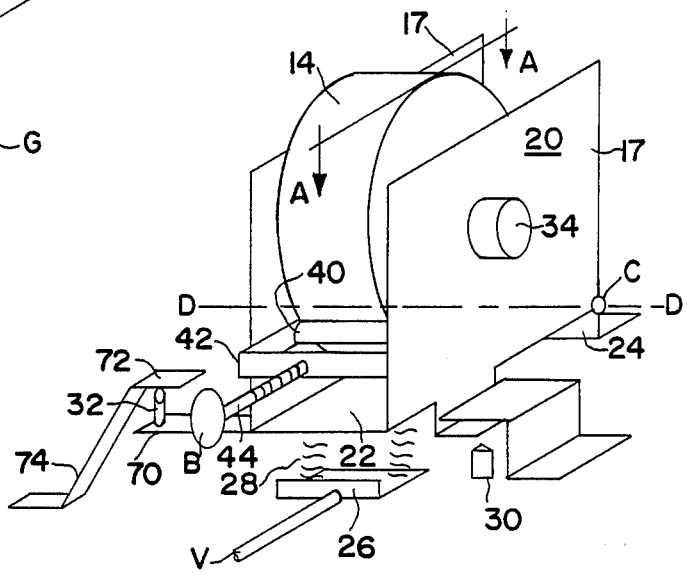
FIG. 2 shows the rotatably mounted wheel on a hinged support.
Figure 3:
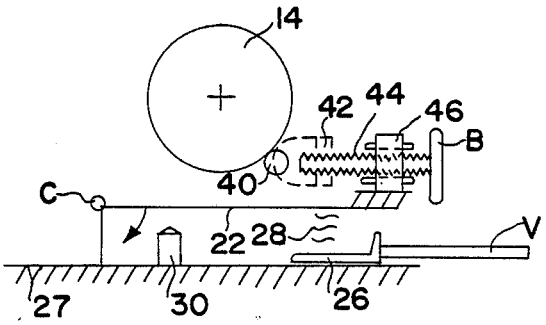
FIG. 3 shows a cross sectional view of the mounting mechanism.
Figure 3A:
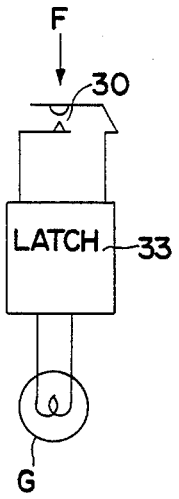
FIG. 3A–C shows a schematic diagram of the signalling means.

In FIG. 2 is shown an isometric view of the mechanical construction of the exerciser "with the box removed". In FIG. 3 is shown a cross sectional view of a the mechanical structure taken along line of sight A—A of FIG. 2. Referring to FIG. 2 and 3, there is shown a wheel 14 whose axel 18 is rotably supported between the sides 17 of a channel 20. The connecting panel 22 of the channel is hinged about centerline D raised above the floor by angle support 24. The other end of the panel is maintained horizontal by resting on springs 28 attached to sliding support 26. Location of the support 26 along panel 22 toward or away from the hinge C is adjusted by manual positioning of a connecting rod V that protrudes through the side of the box. When the vertical force F (indicated by the arrow as shown in FIG. 3A) is exerted by the user on the top of the wheel 14, the springs 26 will then be compressed as the wheel sags (is deflected downward) so that the torque exerted by the user's force about hinge C is opposed by an opposite torque about the hinge that is generated by compressing the spring 28. Therefore, the users force required to deflect the wheel sufficiently to close switch 30 will depend on the distance between the springs in contact with the panel 22 and the hinge C. When no force is applied to the wheel, the panel 22 is parallel to the base 27 of the box 10, so that the (uncompressed) springs can be positioned freely along the panel by sliding rod V.

For a given rod V setting, sufficient vertical thrust on the wheel will depress switch 30. Vertical thrust required to close the switch 30 is increased by sliding the support 26 away from the hinge C.

Referring to FIG. 3 and the partial view FIG. 3A which illustrates certain details more clearly, adjustable resistance to turning of the wheel is imposed by the roller, 40, held against the wheel by a yoke 42. The yoke has a threaded rod 44 treaded through its center. The threaded rod is constrained along its axis by support 46 and the other end of the rod is attached to knob B. Turning knob B causes the roller to move toward or away from the wheel thereby providing controllable resistance to turning of the wheel.

Referring to FIG. 2, every time the wheel is stroked (deflected downward by rotation about the hinge) a second normally closed switch 32 is released. The time between releases of this switch is a measure of the "stride frequency".

The axel of the wheel is coupled to a voltage generator 34 so that the voltage generated is proportional to the velocity of the wheel.

A circuit diagram illustrating the method of presenting the various signals is presented in FIG. 3A.

As discussed above, if the vertical thrust of each stroke is sufficient to overcome the spring support then the wheel will be deflected down on its hinge far enough to close a vertical thrust switch 30. The closing of the vertical thrust switch 30 (a normally open switch) turns on a latch 33 which maintains power to a light G for the length of a delay period thereby signaling to the user that he has reached his goal for vertical thrust. A suitable latch is manufactured by the National Controls Corp. model Q2F-00001-321 which operates from a 12 volt power supply and can be set to maintain the light "on" for 0.3 sec. The latch will maintain the signal light "on" for a period sufficiently long enough to be detected by the user.

Figure 3B:
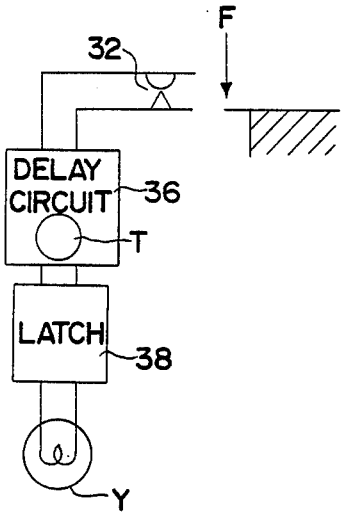

When the wheel is undisturbed, the frequency switch is held open because the switch 32 is attached to an ear 70 extending from the connecting panel 22 of the channel 20 and is in contact with the upper end 72 of a "Z" shaped strap 74 when the channel is undisturbed. (This switch is a normally closed switch.) When the wheel is deflected (even a small amount), the switch is opened long enough to impress a voltage signal on a time delay circuit 36 as shown in FIG. 3B. If the runners stride time is shorter than the time preset by knob T on the delay timer, the signal light Y will not come on and he will hit the wheel again to open the switch and start the next delay period. If the runner is not quick enough, the time delay circuit 36 will close giving a signal to a latch 38 that will turn the frequency light Y on. The light Y will stay on for the latch period, long enough to signal the runner to increase his frequency. Latches 33 and 38 may be identical parts. Delay timer 36 may be model T2k-00010 manufactured by National Controls Corp.

Figure 3C:
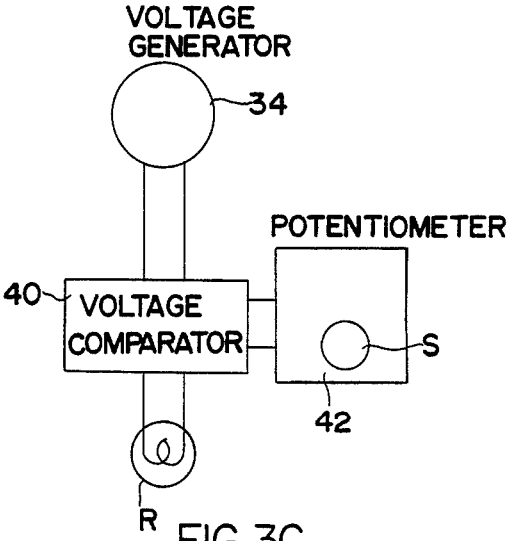

The generator voltage, which is proportional to the rotational velocity of the wheel, is applied to a voltage comparator 40 which will turn on light R when the generator voltage exceeds a value determined by knob S setting the potentiometer 42 as shown in FIG. 3C.

The generator is a model distributed by the W. W. Grainger Corp., San Jose, Calif.

Figure 4:
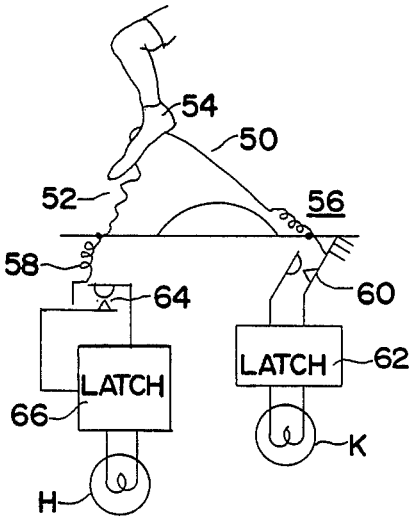
FIG. 4 shows a means for monitoring knee lift and back kick.

In FIG. 4 is shown an additional feature of this invention which is a method of monitoring the knee lift and back kick of the leg.

There are shown cords, 50 and 52, attached at one end to the user's ankle 54 and at the other end to the ends of light springs 56 and 58 respectively. When the user lifts his knee beyond a distance determined by the adjustable length of the cord, the spring 56 is stretched so as to close a switch 60. The closed switch impresses a signal on a latch 62 which turns on a light K.

A similar construction monitors back kick. When the user thrusts his heel back sufficiently at the end of the stroke, he will stretch light spring 58 that will close switch 64. Closing switch 64 will activate latch 66 and thereby turn on light H for the timer period.

The central feature of this invention is a device that monitors the major components of sprinting—frequency, vertical thrust, horizontal thrust, foot speed at ground contact, knee lift and heel lift. A signal for each component is sent to the user while he is performing the exercise so that he can adjust his stroke accordingly. Variations to this invention, such as meter readouts, a different signalling arrangement, etc. will be obvious to one having ordinary skill in the art after reading this specification and studying the drawings and these modifications are within the scope of this invention.

I claim:

1. A device for exercising the muscles used in running which comprises:

a wheel;

a housing having a platform and a base for supporting the user standing on one foot on said platform;

means for rotatably supporting said wheel;

means for connecting said base to said means for supporting said wheel in a location that permits said user to rotate said wheel by strokes from the user's other foot applied to said wheel; and means coupled to said wheel for generating a measurement corresponding to a rotational speed of said wheel and generating a signal responsive to said measurement.

2. A device for exercising as in claim 1 wherein said generating means is an odometer operably engaged with said wheel.

3. A device for exercising as in claim 1 which further comprises a manual adjustable resisting means for adjustably resisting the rotation of said wheel.

4. A device as in claim 3 wherein said resisting means further comprises:

a roller;

a yoke having two ends, each of said ends respectively supporting each end of said roller and having a threaded hole in its center; and a threaded rod threaded into said threaded hole and rotatably mounted thereby forcing said roller against the periphery of said wheel with a force that is determined by the position of said threaded rod in said threaded hole.

5. A device as in claim 1 wherein said generating means comprises an electric generator coupled to said wheel thereby generating a voltage proportional to the rotational speed of said wheel.

6. A device as in claim 5 wherein said generating means further comprises a voltage comparator connected to said generator and a light connected to said comparator that activates when said voltage exceeds a predetermined value.

7. An exercising device as in claim 1 which further comprises a means for emitting a signal corresponding to a frequency with which said user's foot strokes said wheel.

8. A device as in claim 7 wherein:

said connecting means comprises a hinge having one flange connected to said foot supporting base and another flange connected to said wheel supporting means thereby permitting said wheel supporting means to deflect when said wheel is stroked; and said frequency emitting means comprises a signal device and a normally closed switch attached to said wheel supporting means wherein said switch is closed by contact of said switch with said base when said wheel supporting means is undisturbed and wherein said switch moves out of contact with said base and therefore open each time said wheel is stroked thereby causing said signal device connected to said switch to emit said frequency signal.

9. A device as in claim 8 which further comprises a means for emitting a signal corresponding to a vertical force exerted by said foot on said wheel each time said foot strokes said wheel.

10. A device as in claim 9 wherein said wheel supporting means has a flat first surface and said base has a flat second surface facing and parallel to said first surface, both surfaces extending away from said hinge and said vertical force signal means comprises:

at least one spring interposed between and in contact with said surfaces and slideably positioned at a distance from said hinge;

a normally open vertical force switch secured to said base and positioned to close when a vertical force exceeding a predetermined magnitude is exerted on said wheel by said foot strokes causing said wheel supporting means to deflect on said hinge and to contact said vertical force switch; and a force signal emitter circuit connected to said vertical force switch and including a light, wherein each time closing said force switch activates said light;

wherein said predetermined magnitude of said vertical force dependent on said distance of said at least one slideable spring from said hinge.

11. A method for exercising the muscles used in running which includes the steps of:

manually imposing a constant resistance turning a rotatably mounted wheel;

standing on one foot on a platform;

stroking said rotatably mounted wheel with the other foot;

maintaining a frequency with which said wheel is stroked in accordance with a signal corresponding to a predetermined frequency; and monitoring a speed with which said wheel rotates.

12. A method as in claim 11 which further comprises:

monitoring vertical force with which said wheel is stroked.

* * * * *